US007668483B2

(12) United States Patent
Kamoshida et al.

(10) Patent No.: US 7,668,483 B2
(45) Date of Patent: Feb. 23, 2010

(54) IMAGE FORMING APPARATUS

(75) Inventors: Shinichi Kamoshida, Shiojiri (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 424 days.

(21) Appl. No.: 11/781,042

(22) Filed: Jul. 20, 2007

(65) Prior Publication Data

US 2008/0187359 A1 Aug. 7, 2008

(30) Foreign Application Priority Data

Jul. 21, 2006 (JP) ..... 2006-199130

(51) Int. Cl.
*G03G 15/00* (2006.01)

(52) U.S. Cl. ..... 399/159

(58) Field of Classification Search ..... 399/107, 399/109, 110, 116, 117, 159; 29/402.03, 29/895; 492/18, 47
See application file for complete search history.

(56) References Cited

U.S. PATENT DOCUMENTS 7,010,246 B2 * 3/2006 Fujishiro et al. ..... 399/159

FOREIGN PATENT DOCUMENTS

| | | |
|---|---|---|
| JP | 05-035167 | 2/1993 |
| JP | 05-158387 | 6/1993 |
| JP | 2000-155500 | 6/2000 |
| JP | 2001-296723 | 10/2001 |
| JP | 2003-302870 | 10/2003 |
| JP | 2004-233876 | 8/2004 |
| JP | 2005-004005 | 1/2005 |

* cited by examiner

*Primary Examiner*—Hoan H Tran
(74) *Attorney, Agent, or Firm*—Hogan & Hartson LLP

(57) ABSTRACT

Provided is an image forming apparatus which includes a cylindrical image carrier, on which at least an electrostatic latent image is formed, and a charge roller for non-contact charging the image carrier with a predetermined charge gap, and applies at least an alternating current (AC) voltage to the charge roller to non-contact charge the image carrier, wherein a predetermined number of partition members for partitioning an internal space of the image carrier into a plurality of sub-spaces are arranged at a central position of an axial direction of the image carrier or in the vicinity of the central position of the axial direction of the image carrier, in the image carrier.

5 Claims, 7 Drawing Sheets

INTERNAL CONFIGURATION A

INTERNAL CONFIGURATION B

INTERNAL CONFIGURATION C

INTERNAL CONFIGURATION D

INTERNAL CONFIGURATION E

INTERNAL CONFIGURATION F

IMAGE FORMING APPARATUS

BACKGROUND

1. Technical Field

The present invention relates to an image forming apparatus including an electrophotographic device, such as an electrostatic copier, a printer, a facsimile, or the like, which includes an image carrier, on which at least an electrostatic latent image is formed, and a charge roller for non-contact charging the image carrier by bringing gap members fixed on both ends thereof into contact with the image carrier and setting a predetermined charge gap with respect to the image carrier, and applies at least an alternating current (AC) charge bias to the charge roller.

2. Related Art

In the related art, as an image forming apparatus, an image forming apparatus which forms a predetermined charge gap and has a charge roller for non-contact charging an image carrier to perform a non-contact charging method is disclosed in JP-A-2001-296723. In the charge roller used in the image forming apparatus disclosed in JP-A-2001-296723, a resistance layer formed of a conductive elastic member is provided on the outer circumferential surface of a core, a pair of gap members of formed of an insulating film member having a stripe shape are wound in a ring shape to be adhered, and the pair of gap members are brought into contact with the outer circumferential surface of a photosensitive drum which is the image carrier such that the predetermined charge gap is set between the photosensitive drum and a charge portion of the charge roller between the pair of gap members.

Since the charge portion of the charge roller non-contact charges the photosensitive drum via the charge gap such that ozone can be suppressed from being generated and an extraneous material such as a toner attached to the photosensitive drum can be prevented from being attached to the charge roller or a material included in the resistance layer of the charge roller can be prevented from being attached, the capability of charging the photosensitive drum by the charge roller can be improved.

However, in the above-described non-contact charging method, if the charge gap between the photosensitive layer of the photosensitive body and the charge roller is uneven or a rapid environment variation occurs, charging failure may occur and thus image formation failure may occur. Accordingly, in the related art, this problem was solved by applying a charge bias, which is obtained by superposing a direct current (DC) voltage on an AC voltage, to the charge roller.

However, when the charge bias obtained by superposing the direct current (DC) voltage on the AC voltage is applied to the charge roller, the charge roller may vibrate due to the existence of the AC voltage and thus continuous vibration sound may be generated from the photosensitive body due to the vibration of the charge roller. This is because the charge gap is as small as about 20 μm, air in a minute gap between the photosensitive body and the charge roller exhibits a viscous property with respect to the vibration of the charge roller, and thus the photosensitive body and the charge roller integrally vibrate due to the existence of the viscous property of air.

Accordingly, a technology for suppressing the vibration sound of a photosensitive body by completely or substantially filling an elastic vibration suppression member, such as rubber, in the photosensitive body is suggested in JP-A-2003-302870. In the photosensitive body disclosed in JP-A-2003-302870, since the vibration sound of the photosensitive body is absorbed by the elastic vibration suppression member filled in the photosensitive body, the vibration sound of the photosensitive body is suppressed from being generated although the charge roller vibrates when the AC voltage is applied to the charge roller.

SUMMARY

However, in the image forming apparatus disclosed in JP-A-2003-302870, since the elastic vibration suppression member is completely or substantially completely embedded in the inner space of the photosensitive body, the elastic vibration suppression member cannot perform a vibration absorption function with certainty when the AC voltage is applied to the charge roller to vibrate the charge roller. Thus, the vibration of the photosensitive body cannot be efficiently and sufficiently suppressed. Accordingly, the distance (charge gap) between the charge roller and the photosensitive body may vary and thus charging failure and banding failure may occur.

An advantage of the invention is to provide an image forming apparatus capable of more efficiently suppressing vibration sound from being generated from an image carrier although at least an AC voltage is applied to a charge roller for charging an image carrier in a non-contact charging method.

According to an aspect of the invention there is provided an image forming apparatus which includes a cylindrical image carrier, on which at least an electrostatic latent image is formed, and a charge roller for non-contact charging the image carrier with a predetermined charge gap, and applies at least an alternating current (AC) voltage to the charge roller to non-contact charge the image carrier, wherein a predetermined number of partition members for partitioning an internal space of the image carrier into a plurality of sub-spaces are arranged at a central position of an axial direction of the image carrier or in the vicinity of the central position of the axial direction of the image carrier, in the image carrier.

The partition members may be arranged so as to be linearly symmetrical to the central position of the axial direction of the image carrier.

The partition members may be arranged at least at the central position of the axial direction of the image carrier.

The partition members may be formed of an elastic porous member.

The elastic porous member may be a sponge.

According to an image forming apparatus of the invention, since a predetermined number of partition members are provided in an image carrier to partition an internal space of the image carrier into a plurality of sub-spaces, it is possible to more efficiently suppress the large vibration of the image carrier although an AC voltage is applied to a charge roller to vibrate the charge roller.

Accordingly, since the distance between the charge roller and the image carrier is hardly changed and is stably maintained to a predetermined value or less, a charge gap can be stably maintained to be constant. Accordingly, charging failure and banding failure can be prevented and, as a result, a good image can be formed. Vibration sound due to the vibration of the image carrier can be also reduced.

Since an elastic porous member such as a sponge is, for example, used as the partition member, the vibration sound generated at the image carrier is delivered to the partition member via the sub-spaces $S_1$ and $S_2$ so as to be efficiently absorbed into a plurality of holes of the partition member. Accordingly, noise generated at the image carrier can be further reduced.

Accordingly, although an AC voltage is applied to the charge roller to charge the image carrier in a non-contact state, the uniform charge gap can be maintained over a longer duration and thus the image carrier can be stably charged. Accordingly, a high-quality image can be obtained over a long duration.

BRIEF DESCRIPTION OF THE DRAWINGS

The invention will be described with reference to the accompanying drawings, wherein like numbers reference like elements.

FIG. 2 is a schematic view showing a photosensitive body and a charge roller shown in FIG. 1, wherein

DESCRIPTION OF EXEMPLARY EMBODIMENTS

Hereinafter, exemplary embodiments of the invention will be described with reference to the accompanying drawings.

Figure 1:
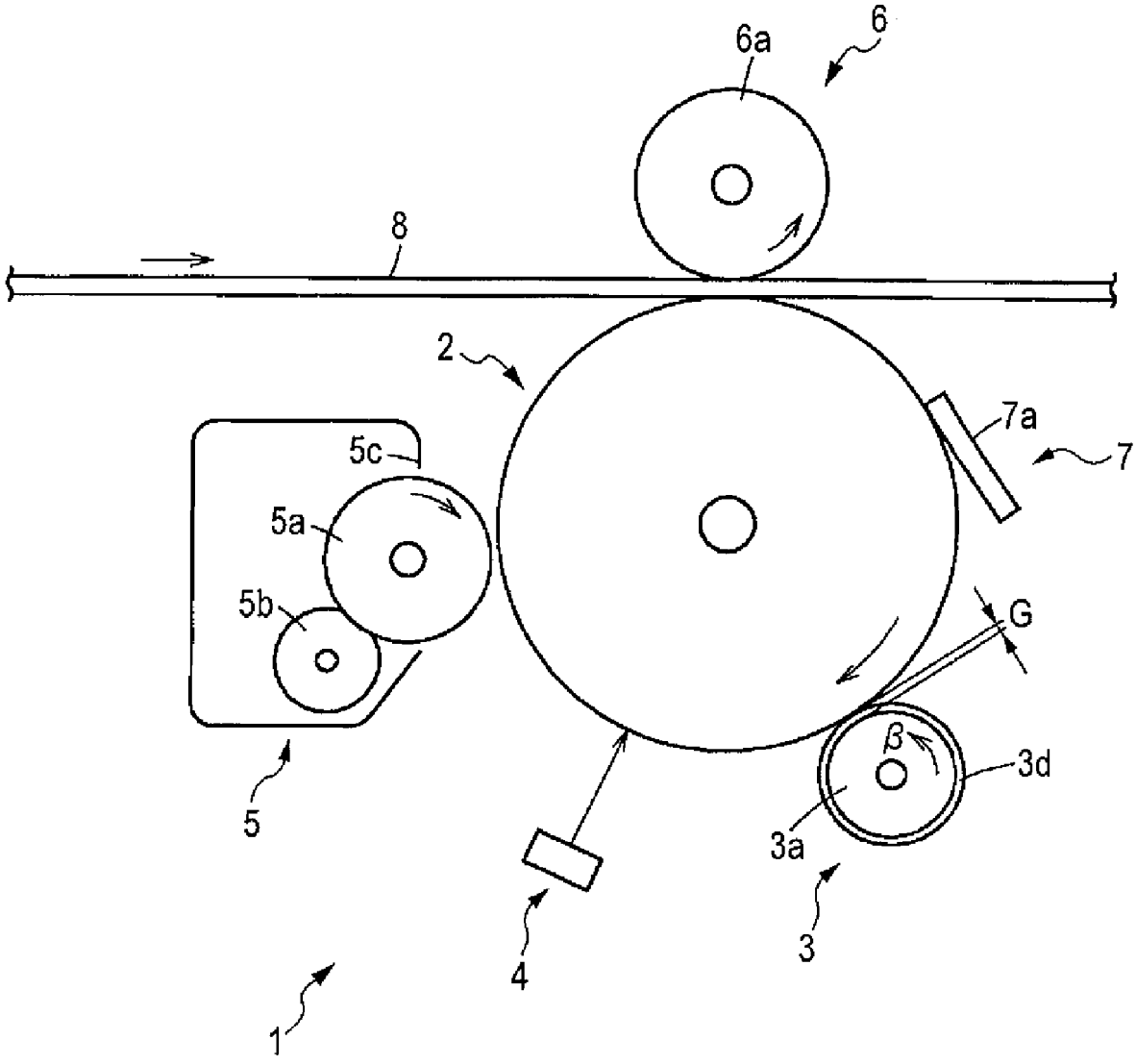
FIG. 1 is a schematic partial view showing an example of an image forming apparatus according to an embodiment of the invention.

FIG. 1 is a schematic partial view showing an example of an image forming apparatus according to an embodiment of the invention. FIG. 2 is a schematic view showing a photosensitive body and a charge roller shown in FIG. 1, wherein FIG. 2A is a front view thereof and FIG. 2B is a cross-sectional view taken along line IIB-IIB of FIG. 1A.

Figure 2A:
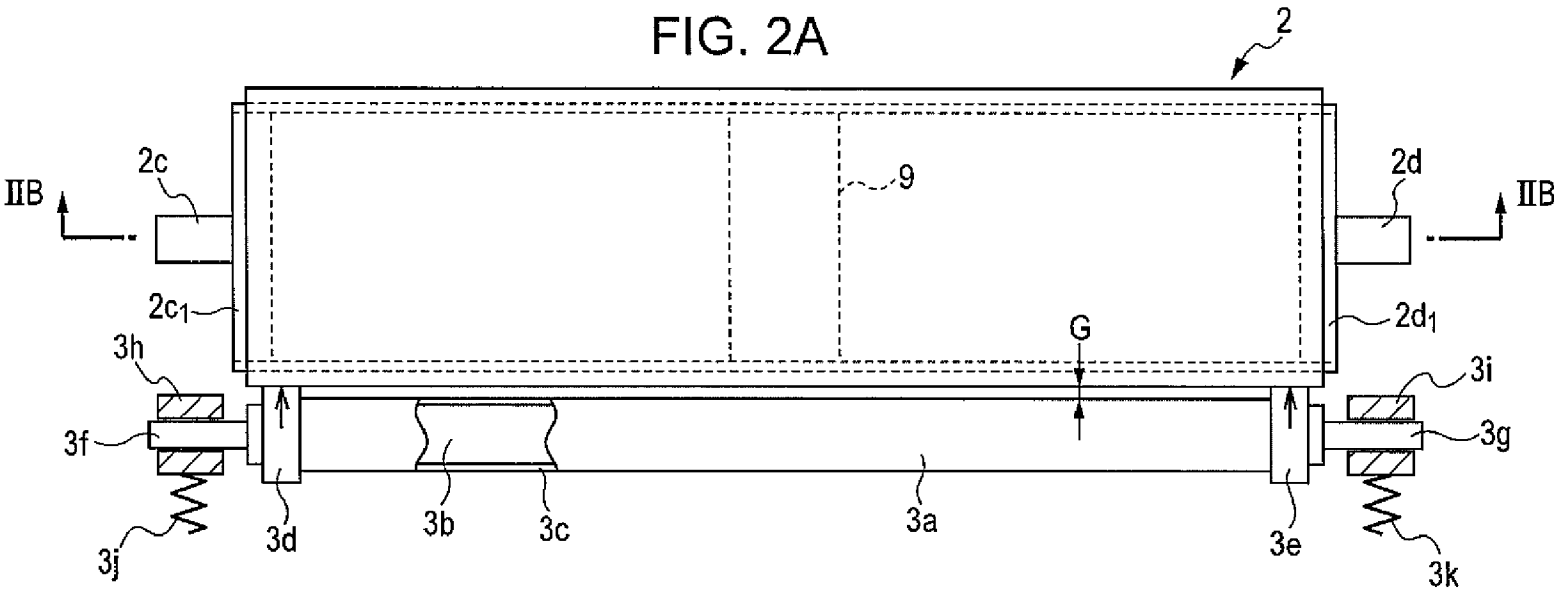
FIG. 2A is a front view thereof and FIG. 2B is a cross-sectional view taken along line IIB-IIB of FIG. 1A.

As shown in FIGS. 1 and 2A, the image forming apparatus 1 includes a photosensitive body 2, which is an image carrier on which an electrostatic latent image and a toner image (developer image) are formed. The photosensitive body 2 rotates in a clockwise direction in FIG. 1. A charge device 3 for non-contact charging the photosensitive body 2, an optical writing device 4 for writing the electrostatic latent image on the photosensitive body 2, a development device 5 for developing the electrostatic latent image of the photosensitive body 2 with a toner, a transfer device for transferring a toner image of the photosensitive body 2, and a cleaning device 7 for cleaning the photosensitive body 2 are sequentially arranged in the vicinity of the photosensitive body 2 from the upstream side of the rotation direction of the photosensitive body 2.

The photosensitive body 2 includes a cylindrical photosensitive drum, in which a photosensitive layer 2*b* having a predetermined thickness is formed on the outer circumferential surface of a cylindrical base metal pipe 2*a*, similar to a known photosensitive drum. In the photosensitive body 2, a conductive pipe formed of, for example, aluminum is used in the base metal pipe 2*a* and a known organic photosensitive material is used in the photosensitive layer 2*b*. Rotary shafts 2*c* and 2*d* coaxially protrude from both ends of the base metal pipe 2*a* such that flange portions $\mathbf{2}c_1$ and $\mathbf{2}d_1$ thereof closely adhere to the inner circumferential surface of the base metal pipe 2*a*. Accordingly, a sealed space S is formed in the base metal pipe 2*a*. The photosensitive body 2 is provided such that the rotary shafts 2*c* and 2*d* are rotatably supported by a main body (not shown) via bearings.

Figure 2B:
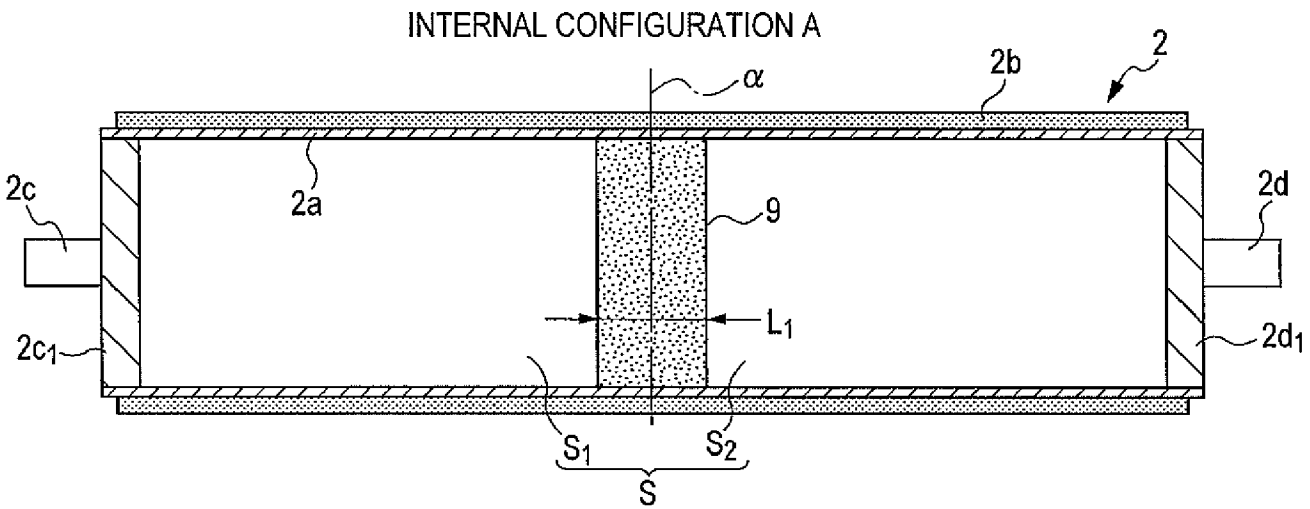

In this image forming apparatus 1, as shown in FIG. 2B, a partition member 9 which partitions the sealed space S in the base metal pipe 2*a* into two left and right sealed sub-spaces $S_1$ and $S_2$ and has a predetermined width $L_1$ is provided in the base metal pipe 2*a*. In this case, the partition member 9 is fixed such that the outer circumferential surface thereof is closely adhered to the inner circumferential surface of the base metal pipe 2*a* and the center of the predetermined width $L_1$ of the partition member 9 corresponds to the central position (particularly, the central position between the facing surfaces of the two left and right flange portions $\mathbf{2}c_1$ and $\mathbf{2}d_1$) $\alpha$ of the axial direction (horizontal direction in FIG. 2B) of the base metal pipe 2*a* (that is, linearly symmetrical to a straight line which passes through the central position $\alpha$ of the base metal pipe 2*a* and is perpendicular to the axial direction).

The partition member 9 is, for example, formed of an elastic porous member such as a sponge. As the elastic sponge, a sponge such as EPT-51 (made by Bridgestone Kaseihin Tokyo Co., Ltd.), Real Sealer (made by Bridgestone Kaseihin Tokyo Co., Ltd.), or QUW (made by Bridgestone Kaseihin Tokyo Co., Ltd.) may be used.

The charge device 3 includes a charge roller 3*a* for non-contact charging the photosensitive body 2 and the charge roller 3*a* rotates in a direction $\beta$ (counterclockwise direction, in FIG. 1) opposite to the rotation direction of the photosensitive body 2. As shown in FIG. 2A, the charge roller has a core 3*b* and the core 3*b* is a conductive shaft formed of, for example, a metal. As the conductive shaft, a shaft obtained by plating the surface of SUM22 with Ni may be used.

First and second gap members 3*d* and 3*e* are fixed on the outer circumferential surfaces of both ends of the core 3*b* by winding a film member formed of, for example, an adhesive tape having a predetermined thickness with a predetermined width in a ring shape. The outer circumferential surface of the core 3*b* between the first and second gap members 3*d* and 3*e* is coated with a conductive coating material by a spray coating method to form a resistance layer 3*c*. The resistance layer may be formed on the entire surface of the outer circumferential surface of the core 3*b* by the same method and then the same first and second gap members 3*d* and 3*e* may be provided on the outer circumferential surfaces of both ends of the resistance layer 3*c*.

The charge roller 3*a* has rotary shafts 3*f* and 3*g*coaxially protruding from both end surfaces of the core 3*b* and the rotary shafts 3*f* and 3*g* are rotatably supported by bearings 3*h* and 3*i*. Similar to the related art, the charge roller 3*a* is pressed toward the photosensitive body 2 by the loads of compression springs 3*j* and 3*k* via the bearings 3*h* and 3*i* of the rotary shafts 3*f* and 3*g* of the charge roller 3*a* such that the first and second gap members 3*d* and 3*e* are pressed against the outer circumferential surface of the photosensitive body 2. Accordingly, a predetermined gap G between the resistance layer 3*c* and the photosensitive body 2 based on the predetermined thickness of the film member is set. In the charge device 3, the photosensitive body 2 is uniformly charged by the charge roller 3*a* in a non-contact state with the charge gap G.

The optical writing device 4 writes an electrostatic latent image on the photosensitive body 2, for example, using laser light. The development device 5 includes a development roller 5*a*, a toner supplying roller 5*b*, and a toner layer thickness regulating member 5*c*. A toner which is a development agent (not shown) is supplied onto the development roller 5*a* by the toner supplying roller 5*b*, the toner on the development roller 5*a* is carried to the photosensitive body 2 after the thickness thereof is regulated by the toner layer thickness regulating member 5*c*, and the electrostatic latent image on the photosensitive body 2 is developed with the carried toner, thereby forming a toner image on the photosensitive body 2.

The transfer device 6 has a transfer roller 6*a*. The toner image on the photosensitive body 2 is transferred onto a transfer medium 8 such as a transfer sheet or an intermediate transfer medium by the transfer roller 6*a*. When the toner image is transferred onto the transfer sheet which is the transfer medium 8, the toner image on the transfer sheet is fixed by the fixing device (not shown) and an image is formed on the transfer sheet. When the toner image is transferred onto the intermediate transfer medium which is the transfer medium 8, the toner image on the intermediate transfer medium is transferred onto a transfer sheet and the toner image on the transfer sheet is fixed by the fixing device (not shown), thereby forming an image on the transfer sheet.

The cleaning device 7 has a cleaning member 7*a* such as a cleaning blade. The photosensitive body 2 is cleaned by the cleaning member 7*a* and the toner left on the photosensitive body 2 after transfer is removed and collected.

In this image forming apparatus 1, since the partition member 9 is provided at the axial central position of the base metal pipe 2*a* of the photosensitive body 2 to partition the space S in the base metal pipe 2*a* into the two sub-spaces $S_1$ and $S_2$, it is possible to more efficiently suppress the large vibration of the photosensitive body 2 although an AC voltage is applied to the charge roller 3*a* to vibrate the charge roller 3*a*. Accordingly, since the distance between the charge roller 3*a* and the photosensitive body 2 is negligibly changed and is stably maintained to a predetermined value or less, the charge gap G can be stably maintained to be constant. Accordingly, charging failure and banding failure can be prevented and, as a result, a good image can be formed. Vibration sound due to the vibration of the photosensitive body 3 can be also reduced.

Since the elastic porous member such as the sponge is, for example, used as the partition member 9, the vibration sound generated at the photosensitive body 2 is delivered to the partition member via the spaces $S_1$ and $S_2$ so as to be efficiently absorbed into a plurality of holes of the partition member 9. Accordingly, noise generated at the photosensitive body 2 can be further reduced.

Accordingly, although a bias obtained by superposing a DC voltage on an AC voltage is applied to the charge roller 3*a* to charge the photosensitive body 2 in a non-contact state, the uniform charge gap G can be maintained over a longer duration and thus the photosensitive body 2 can be stably charged. Accordingly, a high-quality image can be obtained over a long duration.

Figure 3:
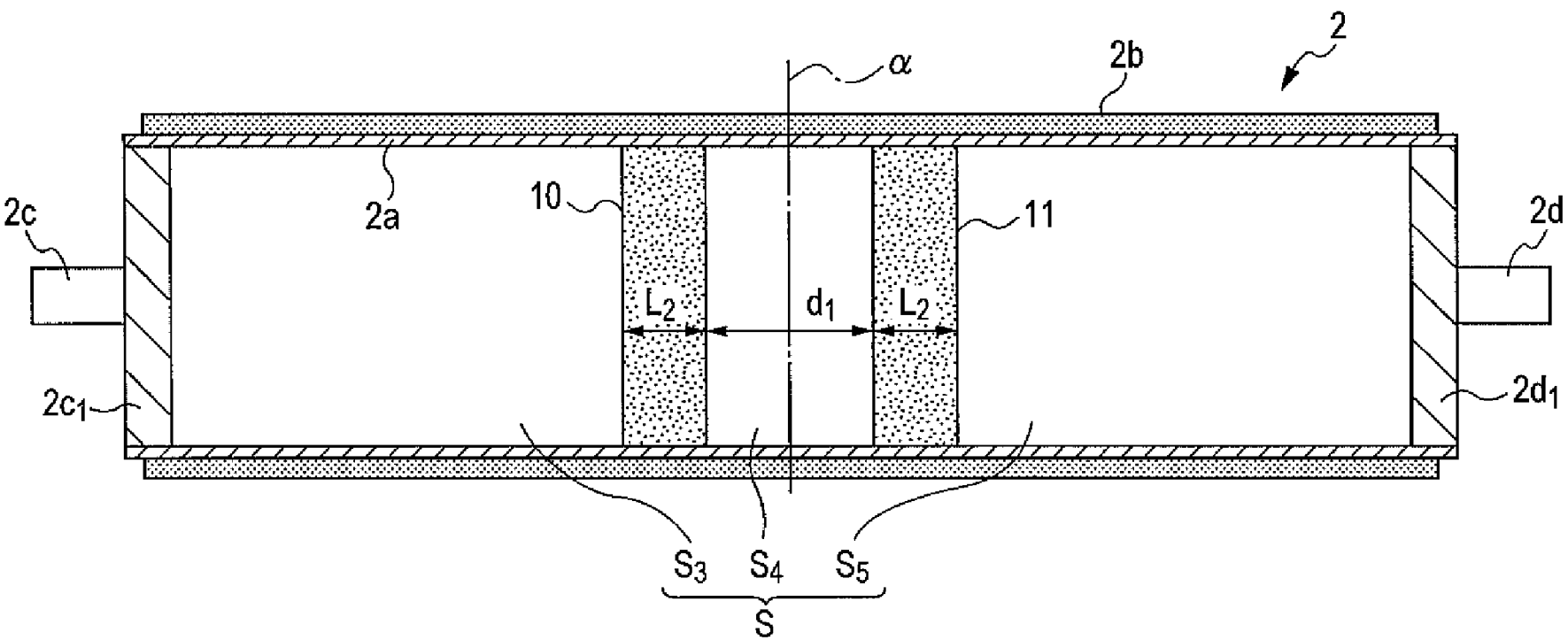
FIG. 3 is a cross-sectional view similar to FIG. 2B but showing a photosensitive body of another example of the image forming apparatus according to the embodiment of the invention.

FIG. 3 is a cross-sectional view similar to FIG. 2B but showing a photosensitive body of another example of the image forming apparatus according to the embodiment of the invention.

Although, in the example shown in FIG. 2B, one partition member 9 having the width $L_1$ is provided in the base metal pipe 2*a* of the photosensitive body 2 to partition the sealed space S in the base metal pipe 2*a* into the two sub-spaces $S_1$ and $S_2$, in the photosensitive body 2 of the image forming apparatus shown in FIG. 3, two partition members 10 and 11 each having a predetermined width $L_2$ are provided in the base metal pipe 2*a* to partition the sealed space S in the base metal pipe 2*a* into three sub-spaces $S_3$, $S_4$ and $S_5$. In this case, the two partition members 10 and 11 are not provided at the central position α and are positioned in the vicinity of the central position α at a predetermined distance $d_1$ so as to be linearly symmetrical to a straight line which passes through the central position α and is perpendicular to the axial direction. The two partition members 10 and 11 are formed of the same elastic porous member as the partition member 9 of the above-described example.

The other configuration of the photosensitive body 2 and the other configuration of the image forming apparatus 1 of this example are respectively the same as those of the photosensitive body 2 and the image forming apparatus 1 shown in FIGS. 1, 2A and 2B, and the operation and the effect of the photosensitive body 2 and the image forming apparatus 1 of this example are substantially the same as those of the photosensitive body 2 and the image forming apparatus 1 of the above-described example. The widths $L_2$ of the two partition members 10 and 11 may be different from each other. In this case, the two partition members 10 and 11 are not linearly symmetrical to the straight line passing through the central position α.

Figure 4:
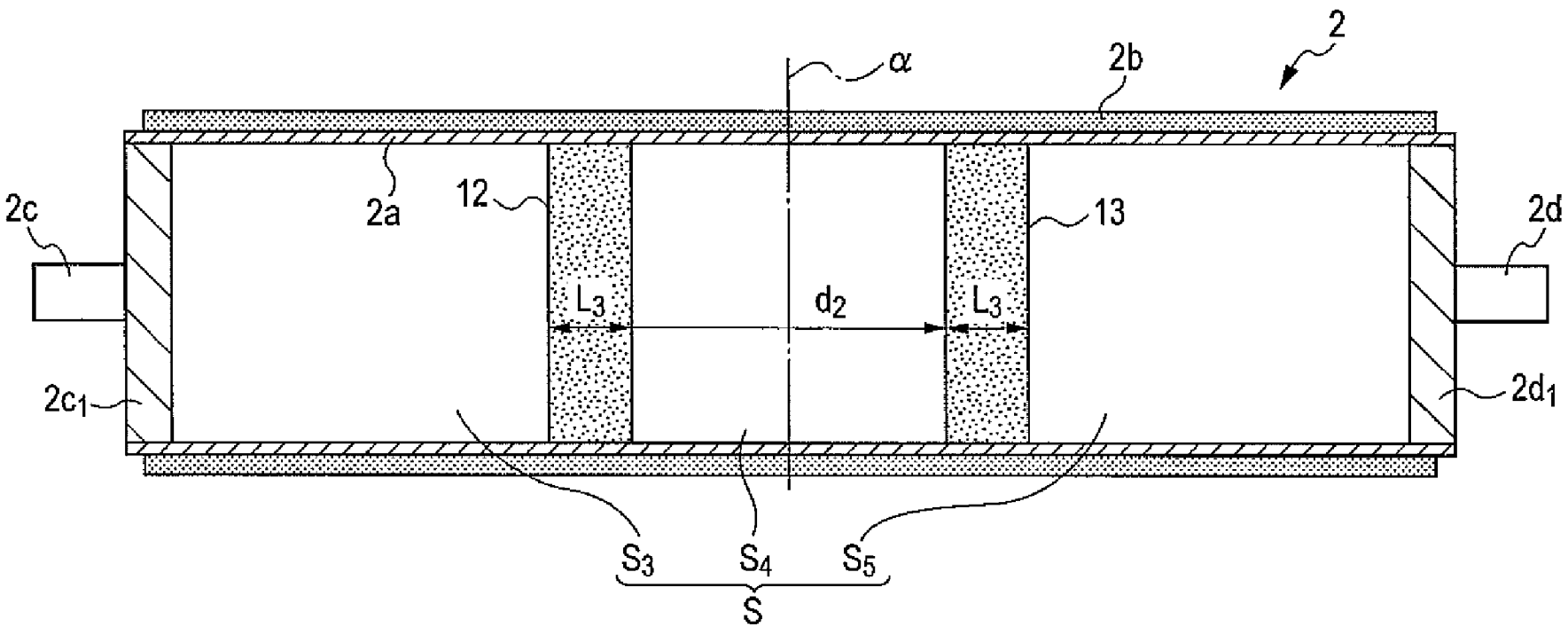
FIG. 4 is a cross-sectional view similar to FIG. 2B but showing a photosensitive body of another example of the image forming apparatus according to the embodiment of the invention.

FIG. 4 is a cross-sectional view similar to FIG. 2B but showing a photosensitive body of another example of the image forming apparatus according to the embodiment of the invention.

Although, in the example shown in FIG. 3, the two partition members 10 and 11 each having the predetermined width $L_2$ are provided in the base metal pipe 2*a* at the predetermined distance $d_1$ so as to be linearly symmetrical to the straight line passing through the central position α, in the photosensitive body 2 of the image forming apparatus 1 shown in FIG. 4, two partition members 12 and 13 each having a predetermined width $L_3$ are provided in the base metal pipe 2*a* at a predetermined distance $d_2$ larger than the distance $d_1$ so as to be linearly symmetrical to the central position α. The two partition members 12 and 13 are formed of the same elastic porous member as the partition member 9 of the above-described example. Since the photosensitive body 2 is schematically shown in FIG. 4, the two partition members 12 and 13 are shown to be farther away from the flange portions $2c_1$ and $2d_1$ than the central position α. However, actually, half the axial distance $d_2$ of the sub-space S4 is set to be significantly smaller than the axial distance of the left and right sub-spaces $S_3$ and $S_5$. That is, the two partition members 12 and 13 are arranged closer to the central position α than the flange portions $2c_1$ and $2d_1$ and, in this case, the two partition members 12 and 13 are arranged in the vicinity of the central position α.

The other configuration of the photosensitive body 2 and the other configuration of the image forming apparatus 1 of this example are equal to those of the above-described example, and the operation and the effect of the photosensitive body 2 and the image forming apparatus 1 of this example are substantially equal to those of the above-described example. The widths $L_3$ of the two partition members 12 and 13 may be different from each other. In this case, the two partition members 12 and 13 are not linearly symmetrical to the straight line passing through the central position α.

Figure 5:
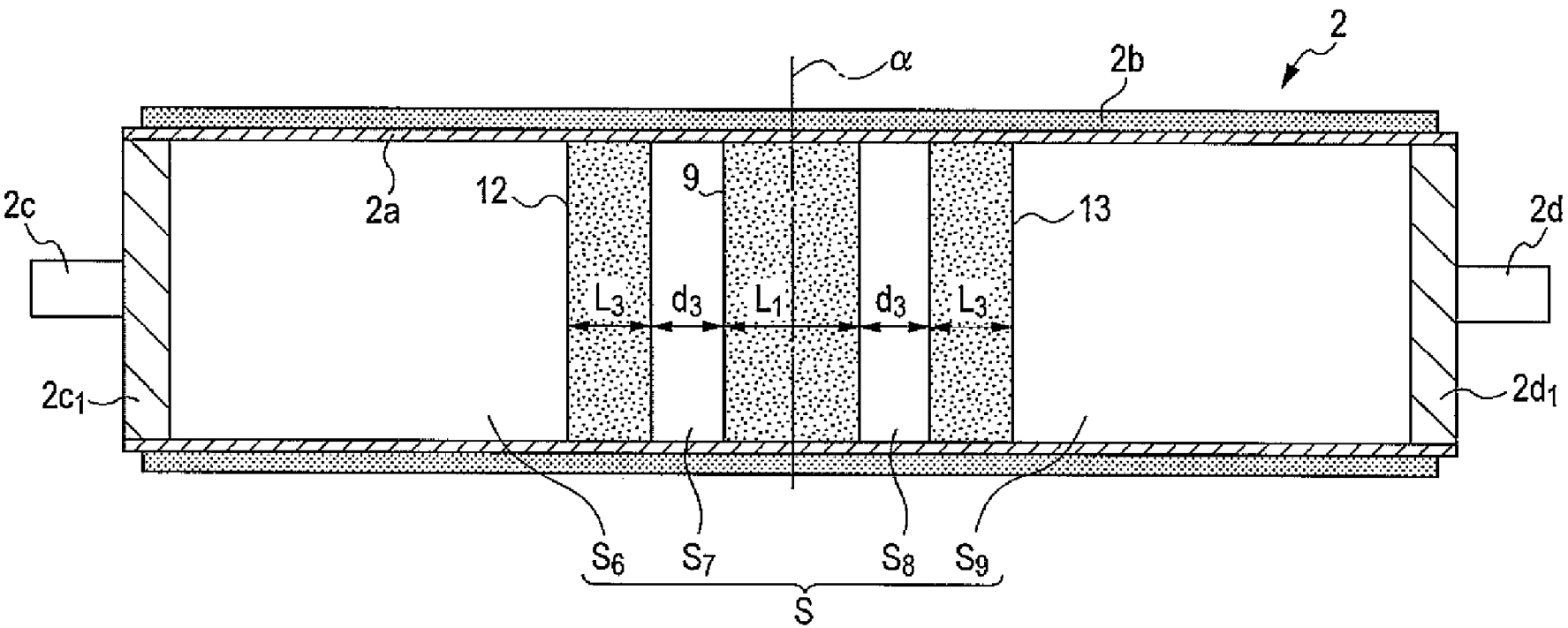
FIG. 5 is a cross-sectional view similar to FIG. 2B but showing a photosensitive body of another example of the image forming apparatus according to the embodiment of the invention.

FIG. 5 is a cross-sectional view similar to FIG. 2B but showing a photosensitive body of another example of the image forming apparatus according to the embodiment of the invention.

As shown in FIG. 5, in the photosensitive body 2 of the image forming apparatus 1 of this example, a combination of one partition member 9 of the photosensitive body 2 shown in FIGS. 2A and 2B and the two partition members 12 and 13 of the photosensitive body 2 shown in FIG. 4 is formed. In this case, the partition member 9 is provided similar to the example shown in FIGS. 2A and 2B and the two partition members 12 and 13 are provided similar to the example shown in FIG. 4. Accordingly, one partition member 9 is arranged between the two partition members 12 and 13 to form a predetermined distance $d_3$ therebetween. The sealed space S in the base metal pipe 2*a* is partitioned into four sub-spaces $S_6$, $S_7$, $S_8$ and $S_9$ by the three partition members 9, 12 and 13.

The other configuration of the photosensitive body 2 and the other configuration of the image forming apparatus 1 of this example are equal to those of the above-described example, and the operation and the effect of the photosensitive body 2 and the image forming apparatus 1 of this example are substantially equal to those of the above-described examples. The widths $L_3$ of the two partition members 12 and 13 may be different from each other. In this case, the two partition members 12 and 13 are not linearly symmetrical to the straight line passing through the central position α.

Although the partition members 9, 10, 11, 12 and 13 are provided so as to be linearly symmetrical to the central position α in the above-described examples, the invention is not limited to the examples and the partition members 9, 10, 11, 12 and 13 may not necessarily provided so as to be linearly symmetrically to the central position α. However, in order to suppress a variation in distance between the photosensitive body 2 and the charge roller 3*a* as small as possible and equalize the distance between the photosensitive body 2 and the charge roller 3*a* in the axial direction as much as possible, it is preferable that the partition members 9, 10, 11, 12 and 13 are provided so as to be linearly symmetrical to the central position α.

Next, an experiment for confirming the effect which can be obtained by the invention was performed.

Experimental Apparatus

As an experimental apparatus, a device obtained by reconstructing a color printer LP9000C which is made by Seiko Epson Corporation and is available commercially was used. The outline of the experimental apparatus is shown in Table 1.

TABLE 1

| Element | Details |
|---|---|
| Photosensitive body | Photosensitive drum of LP9000C(made by SEIKO EPSON CORPORATION) |
| Charge roller | Non-contact AC Charge roller<br>Metal roller having a diameter ϕ +<br>Resistance layer (surface layer) having a thickness 30 μm of Table 2<br>Standard specifications of the material of resistance layer: polyurethane resin of 30 wt %, |

TABLE 1-continued

| Element | Details |
|---|---|
| | acrylic resin of 30 wt %, and conductive tin oxide of 40 wt %<br>The amount of the conductive tin oxide was adjusted to become ±10 wt % from the standard specifications and a variation in amount of conductive tin oxide was adjusted by varying the amount of polyurethane resin.<br>Gap member: polyester table having a thickness 22 μm<br>Charge region width: 330 mm<br>Gap width (one side): 5 mm<br>Contact pressure: 500 gf/cm |
| Cleaning blade | Cleaning blade of LP9000C (made by SEIKO EPSON CORPORATION) |
| Optical writing device | Exposure unit of LP9000C (made by SEIKO EPSON CORPORATION) |
| Development device | Development device of LP9000C (made by SEIKO EPSON CORPORATION) (including a genuine toner) |
| Transfer device | Transfer device of LP9000C (made by SEIKO EPSON CORPORATION) (including a transfer belt) |
| Fixing device | Fixing device of LP9000C (made by SEIKO EPSON CORPORATION) |
| AC power source | TreK (for AC output) (made by TREK, INC. of United States) |

As shown in Table 1, in an image forming apparatus which is the experimental apparatus, a photosensitive drum, a cleaning blade, an optical writing device, a development device (including a genuine toner), a transfer device (including an intermediate transfer belt), and a fixing device of the color printer LP9000C made by Seiko Epson Corporation were used as a photosensitive body, a cleaning blade, an optical writing device which is an exposure device, a development device, a transfer device, and a fixing device, respectively.

A photosensitive body 2 having a sponge filling and a photosensitive body having no a sponge filling were manufactured, several charge rollers (CR) 3*a* were manufactured, and Experiments 1 to 16 were performed by various combinations of the photosensitive bodies 2 and the charge rollers 3*a*.

The photosensitive body 2 having the sponge was configured by providing a sponge in the base metal pipe 2*a* of the photosensitive drum of the printer LP9000C. The distance between the facing surfaces of a pair of left and right flange portions $2c_1$ and $2d_1$ of the photosensitive body 2 (effective length of the axial direction of the base metal pipe 2*a*) is 318 mm. As the sponge, EPT-51 purchased from Bridgestone Kaseihin Tokyo Co., Ltd was used. The internal configurations of the photosensitive drums used in the experiments are shown in Table 2.

TABLE 2

| | CR | | | | | | Photosensitive body | | result | |
|---|---|---|---|---|---|---|---|---|---|---|
| No. | ϕ (mm) | G (μm) | R (Ω) | $V_{DC}$ (−V) | $V_{PP}$ (V) | f (Hz) | Internal configuration | Type of filling | Acoustic pressure (dB) | |
| 1 | 9 | 20 | $1.2 \times 10^6$ | 600 | 1600 | 1.3 | A | Sponge | 42 | ○ |
| 2 | 10 | 21 | $5.2 \times 10^6$ | 580 | 1650 | 1.2 | B | Sponge | 43 | ○ |
| 3 | 11 | 18 | $5.2 \times 10^7$ | 590 | 1700 | 1.5 | C | Sponge | 45 | ○ |
| 4 | 12 | 34 | $5.2 \times 10^5$ | 550 | 1800 | 1.4 | D | Sponge | 44 | ○ |
| 5 | 9 | 28 | $1.2 \times 10^7$ | 600 | 1690 | 1.6 | A | Sponge | 45 | ○ |
| 6 | 10 | 26 | $8.2 \times 10^6$ | 580 | 1800 | 1.2 | B | Sponge | 44 | ○ |
| 7 | 11 | 27 | $3.2 \times 10^7$ | 590 | 1900 | 1.3 | C | Sponge | 46 | ○ |
| 8 | 12 | 45 | $6.2 \times 10^6$ | 550 | 1890 | 1.5 | D | Sponge | 46 | ○ |

TABLE 2-continued

| | CR | | | | | | Photosensitive body | | result | |
|---|---|---|---|---|---|---|---|---|---|---|
| No. | ϕ (mm) | G (μm) | R (Ω) | $V_{DC}$ (−V) | $V_{PP}$ (V) | f (Hz) | Internal configuration | Type of filling | Acoustic pressure (dB) | |
| 9 | 9 | 20 | $1.2 \times 10^6$ | 600 | 1600 | 1.3 | E | Sponge | 53 | X |
| 10 | 10 | 21 | $5.2 \times 10^6$ | 580 | 1650 | 1.2 | F | None | 55 | X |
| 11 | 11 | 18 | $5.2 \times 10^7$ | 590 | 1700 | 1.5 | E | Sponge | 56 | X |
| 12 | 12 | 34 | $5.2 \times 10^5$ | 550 | 1800 | 1.4 | F | None | 54 | X |
| 13 | 9 | 28 | $1.2 \times 10^7$ | 600 | 1690 | 1.6 | E | Sponge | 57 | X |
| 14 | 10 | 26 | $8.2 \times 10^6$ | 580 | 1800 | 1.2 | F | None | 58 | X |
| 15 | 11 | 27 | $3.2 \times 10^7$ | 590 | 1900 | 1.3 | E | Sponge | 56 | X |
| 16 | 12 | 45 | $6.2 \times 10^6$ | 550 | 1890 | 1.5 | F | None | 59 | X |

The charge roller 3*a* is a non-contact charge roller, the metal core 3*b* was formed by plating the surface SUM22 with Ni, and the surface layer formed of the resistance layer having a thickness 30 μm was formed on the core 3*b* having a diameter ϕ shown in Table 2. The standard specifications of the material of the resistance layer 3*c* include polyurethane resin of 30 wt %, acrylic resin of 30 wt %, and conductive tin oxide of 40 wt %. In this case, the amount of the conductive tin oxide was adjusted to become ±10 wt % from the standard specifications and a variation in amount of conductive tin oxide was adjusted by varying the amount of polyurethane resin. The gap members 3*d* and 3*e* for forming the charge gap G on the surface layer of the both ends were configured by winding a polyester tape having a thickness of 22 μm on the resistance layer 3*c*. In this case, the charge roller 3*a* used in the present experiment was completed by doubly winding the polyester tape at predetermined positions of the both ends of the core 3*b* and coating the outer circumferential surface of the core 3*a* with a material obtained by dissolving the above-described material in water and ethanol to form the resistance layer 3*c*.

As an AC power supply, Trek (for AC output) (made by TREK, INC. of United States) was used. As a DC power supply, one's own work was used.

In addition, the image forming apparatus shown in FIG. 1 was manufactured using the above-described components.

Experimental Conditions And Results

In Experiments 1 to 16, printing tests were performed under the experimental conditions shown in Table 2. Experiments 1 to 16 have common experimental conditions that the charge voltage applied to the charge roller 3*a* was a voltage obtained by superposing a DC voltage $V_{DC}$ on an AC voltage $V_{PP}$ and the AC voltage $V_{PP}$ was a sine wave. In addition, the process velocity was 210 mm/sec and the ratio of the circumferential velocity of the charge roller to the circumferential velocity of the photosensitive body was 1. The experimentally obtained applied voltage was a voltage obtained by superposing the DC voltage on the AC voltage and was a rectangular wave (duty cycle of 50%) wherein the DC voltage $V_{DC}$ was −200 V, the AC voltage $V_{PP}$ was 1400 V, the frequency f of the AC voltage was 3.0 kHz, and the transfer applied voltage was +200 V.

The experimental conditions of each of Experiments 1 to 16 will be described.

As shown in Table 2, the experimental conditions of Experiment 1 were as follows: the diameter ϕ of the metal shaft of the charge roller (CR) was 9 mm, the gap G was 20 μm, the resistance R of the resistance layer was $1.2\times10^6$ Ω, the DC voltage $V_{DC}$ of the charge voltage was −600 V, the AC voltage $V_{PP}$ of the charge voltage was 1600 V, the frequency f of the AC voltage $V_{PP}$ was 1.3 Hz, the internal configuration of the photosensitive body was the configuration shown in FIGS. 2A and 2B (denoted by A in Table 2), and the partition member of the sponge was included. The width $L_1$ of the partition member 9 was 20 mm.

In the experimental conditions of Experiment 2 were as follows: the diameter ϕ was 10 mm, the gap G was 21 μm, the resistance R was $5.2\times10^6$ Ω, the DC voltage $V_{DC}$ was −600 V, the AC voltage $V_{PP}$ was 1650 V, the frequency f was 1.2 Hz, the internal configuration was the configuration shown in FIG. 3 (denoted by B in Table 2), and the sponge was included. The widths $L_2$ of the partition members 10 and 11 were 10 mm and the distance $d_1$ between the partition members 10 and 11 was 20 mm.

The experimental conditions of Experiment 3 were as follows: the diameter ϕ was 11 mm, the gap G was 18 μm, the resistance R was $5.2\times10^7$ Ω, the DC voltage $V_{DC}$ was −590 V, the AC voltage $V_{PP}$ was 1700 V, the frequency f was 1.5 Hz, the internal configuration was the configuration shown in FIG. 4 (denoted by C in Table 2), and the sponge was included. The widths $L_3$ of the partition members 12 and 13 were 10 mm and the distance $d_2$ between the partition members 12 and 13 was 40 mm.

The experimental conditions of Experiment 4 were as follows: the diameter ϕ was 12 mm, the gap G was 34 μm, the resistance R was $5.2\times10^5$ Ω, the DC voltage $V_{DC}$ was −550 V, the AC voltage $V_{PP}$ was 1800 V, the frequency f was 1.4 Hz, the internal configuration was the configuration shown in FIG. 5 (denoted by D in Table 2), and the sponge was included. The width $L_1$ of the partition member 9 was 20 mm, the widths $L_3$ of the partition members 12 and 13 were 10 mm, and the distance $d_3$ between the partition members 9 and 12 and the distance $d_3$ between the partition members 9 and 13 were 10 mm.

The experimental conditions of Experiment 5 were as follows: the diameter ϕ was 9 mm, the gap G was 28 μm, the resistance R was $1.2\times10^7$ Ω, the DC voltage $V_{DC}$ was −600 V, the AC voltage $V_{PP}$ was 1690 V, the frequency f was 1.6 Hz, the internal configuration was the same configuration A as that in Experiment 1, and the sponge was included.

The experimental conditions of Experiment 6 were as follows: the diameter ϕ was 10 mm, the gap G was 26 μm, the resistance R was $8.2\times10^5$ Ω, the DC voltage $V_{DC}$ was −580 V, the AC voltage $V_{PP}$ was 1800 V, the frequency f was 1.2 Hz, the internal configuration was the same configuration B as that in Experiment 2, and the sponge was included.

The experimental conditions of Experiment 7 were as follows: the diameter ϕ was 11 mm, the gap G was 27 μm, the resistance R was $3.2\times10^7$ Ω, the DC voltage $V_{DC}$ was −590 V, the AC voltage $V_{PP}$ was 1900 V, the frequency f was 1.3 Hz, the internal configuration was the same configuration C as that in Experiment 3, and the sponge was included.

The experimental conditions of Experiment 8 were follows, the diameter ϕ was 12 mm, the gap G was 45 μm, the resistance R was $6.2\times10^6$ Ω, the DC voltage $V_{DC}$ was −550 V, the AC voltage $V_{PP}$ was 1890 V, the frequency f was 1.5 Hz, the internal configuration was the same configuration D as Experiment 4, and the sponge was included.

Figure 6:
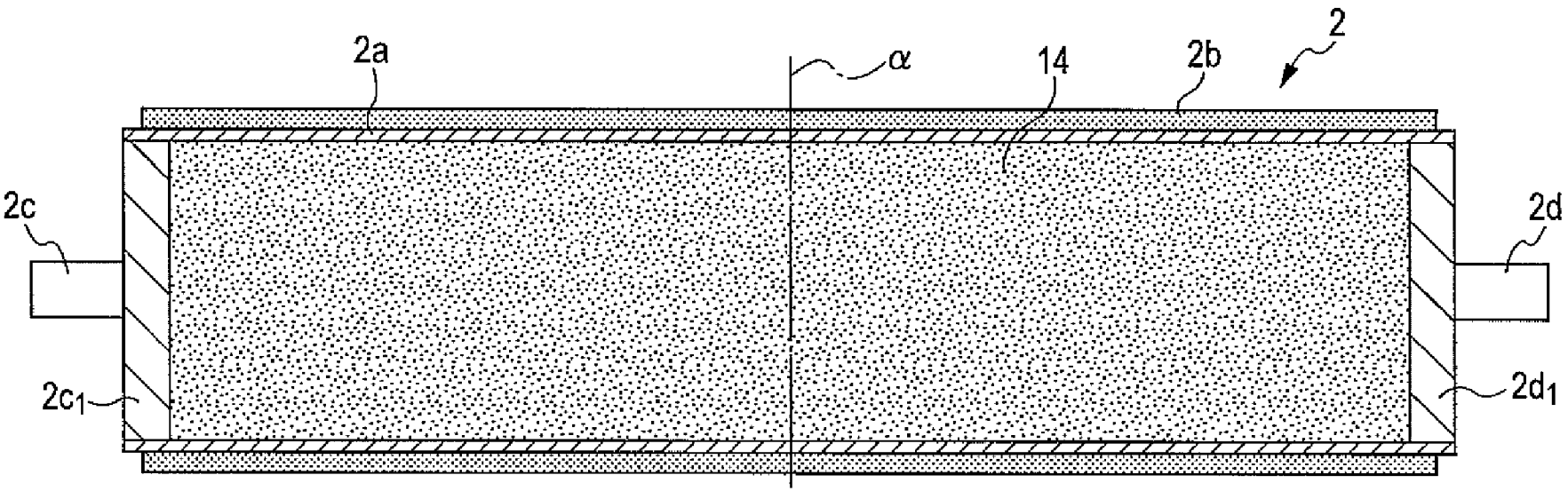
FIG. 6 is a cross-sectional view similar to FIG. 2B but showing a photosensitive body of a comparative example of the invention.

The experimental conditions of Experiment 9 were as follows, the diameter ϕ was 9 mm, the gap G was 20 μm, the resistance R was $1.2\times10^6$ Ω, the DC voltage $V_{DC}$ was −600 V, the AC voltage $V_{PP}$ was 1600 V, the frequency f was 1.3 Hz, the internal configuration was the configuration shown in FIG. 6 (denoted by E in Table 2), and the sponge was included. As shown in FIG. 6, in the photosensitive body 2 used in this experiment, the sponge 14 is completely or substantially completely filled in the base metal tube 2*a*, and the sealed space S in the base metal pipe 2*a* is not partitioned into a plurality of sub-spaces. That is, the sponge does not configure the partition member.

Figure 7:
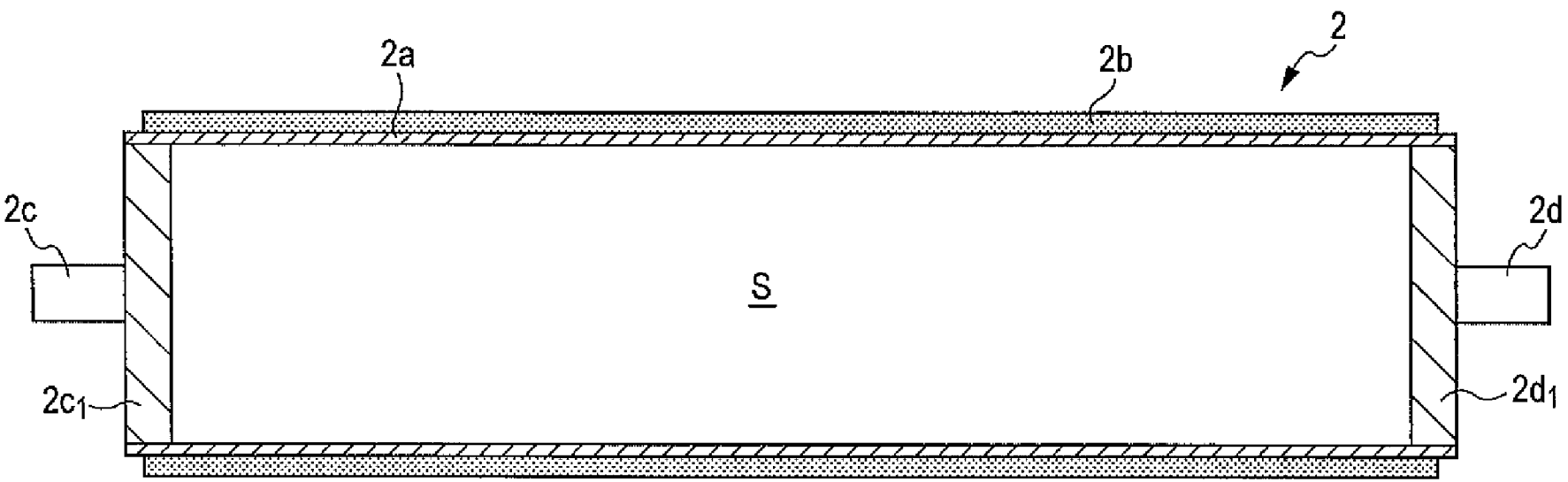
FIG. 7 is a cross-sectional view similar to FIG. 2B but showing a photosensitive body of another comparative example of the invention.

The experimental conditions of Experiment 10 were as follows: the diameter ϕ was 10 mm, the gap G was 21 μm, the resistance R was $5.2\times10^6$ Ω, the DC voltage $V_{DC}$ was −580 V, the AC voltage $V_{PP}$ was 1650 V, the frequency f was 1.2 Hz, the internal configuration was the configuration shown in FIG. 7 (denoted by F in Table 2), and the sponge was not included. As shown in FIG. 7, in the photosensitive body 2 used in this experiment, the sponge is not disposed inside the base metal tube 2*a*, and the sealed space S in the base metal pipe 2*a* is not partitioned into a plurality of sub-spaces.

The experimental conditions of Experiment 11 were as follows: the diameter ϕ was 11 mm, the gap G was 18 μm, the resistance R was $5.2\times10^7$ Ω, the DC voltage $V_{DC}$ was −590 V, the AC voltage $V_{PP}$ was 1700 V, the frequency f was 1.5 Hz, the internal configuration was the same configuration E as that in Experiment 9, and the sponge was included.

The experimental conditions of Experiment 12 were as follows: the diameter ϕ was 12 mm, the gap G was 34 μm, the resistance R was $5.2\times10^5$ Ω, the DC voltage $V_{DC}$ was −550 V, the AC voltage $V_{PP}$ was 1800 V, the frequency f was 1.4 Hz, the internal configuration was the same configuration F as that in Experiment 10, and the sponge was not included.

The experimental conditions of Experiment 13 were as follows, the diameter ϕ was 9 mm, the gap C was 28 μm, the resistance R was $1.2\times10^7$ Ω, the DC voltage $V_{DC}$ was −600 V, the AC voltage $V_{PP}$ was 1690 V, the frequency f was 1.6 Hz, the internal configuration was the same configuration E as that in Experiment 9, and the sponge was included.

The experimental conditions of Experiment 14 were as follows: the diameter ϕ was 10 mm, the gap G was 26 μm, the resistance R was $8.2\times10^6$ Ω, the DC voltage $V_{DC}$ was −580 V, the AC voltage $V_{PP}$ was 1800 V, the frequency f was 1.2 Hz, the internal configuration was the same configuration F as that in Experiment 10, and the sponge was not included.

The experimental conditions of Experiment 15 were as follows: the diameter ϕ was 11 mm, the gap G was 27 μm, the resistance R was $3.2\times10^7$ Ω, the DC voltage $V_{DC}$ was −590 V, the AC voltage $V_{PP}$ was 1900 V, the frequency f was 1.3 Hz, the internal configuration was the same configuration E as that in Experiment 9, and the sponge was included.

The experimental conditions of Experiment 16 were as follows: the diameter ϕ was 12 mm, the gap G was 45 μm, the resistance R was $6.2\times10^6$ Ω, the DC voltage $V_{DC}$ was −550 V, the AC voltage $V_{PP}$ was 1890 V, the frequency f was 1.5 Hz, the internal configuration was the same configuration F as that in Experiment 10, and the sponge was not included.

Accordingly, Experiments 1 to 8 are embodiments of the invention and Experiments 9 to 16 are comparative examples of the invention.

Noise Measurement Test

A noise measurement test is the same in Experiments 1 to 16 and monochromic printing of 5% was sequentially performed with respect to 100 sheets of plain paper having A4 size, and an acoustic pressure (dB) for 10 seconds was measured using a normal sound level meter LA-1210 (made by ONO SOKKI CO., LTD.) between $20^{th}$ to $80^{th}$ sheets. The environment for measuring noise at this time is a normal environment (a temperature 23° C. and a humidity is 65% R.H.).

Result

The experimental result is shown in Table 2. In this case, an FFT analysis was performed with respect to the measured acoustic pressure (dB), a frequency component (one-time vibration (3.0 kHz) to 6-time vibration (18.0 kHz) of a development frequency of 3.0 kHz was deleted, and comparison and evaluation were performed as the whole acoustic pressure, thereby obtaining the acoustic pressure (dB). If the obtained acoustic pressure (dB) is equal to or greater than 50 (dB), it was determined to be bad (x) and, if the obtained acoustic pressure (dB) is less than 50 (dB), it was determined to be good (○).

As can be seen from Table 2, in the Experiments 1 to 8 of the embodiments of the invention, since the acoustic pressure (dB) is less than 50 dB and is relatively small, the photosensitive body 2 does not vibrate although the AC voltage is applied to the charge roller 3*a* and thus a good result is obtained. In the Experiments 9 to 16 of the comparative examples of the invention, since the acoustic pressure (dB) is equal to or greater than 50 dB, the photosensitive body 2 greatly vibrates and thus a bad result is obtained. Accordingly, it was confirmed that the effect can be obtained by the invention.

An image forming apparatus of the invention is applicable to an image forming apparatus including electrophotographic device which includes an image carrier, on which at least an electrostatic latent image is formed, and a charge roller for non-contact charging the image carrier by bringing gap members fixed on the both ends thereof into contact with the image carrier and setting a predetermined charge gap with respect to the image carrier, and applies at least an alternating current (AC) charge bias to the charge roller, such as an electrostatic copier, a printer, a facsimile, or the like.

What is claimed is:

1. An image forming apparatus which includes a cylindrical image carrier, on which at least an electrostatic latent image is formed, and a charge roller for non-contact charging the image carrier with a predetermined charge gap, and applies at least an alternating current (AC) voltage to the charge roller to non-contact charge the image carrier, wherein a predetermined number of partition members for partitioning an internal space of the image carrier into a plurality of sub-spaces are arranged at a central position of an axial direction of the image carrier or in the vicinity of the central position of the axial direction of the image carrier, in the image carrier.

2. The image forming apparatus according to claim 1, wherein the partition members are arranged so as to be linearly symmetrical to the central position of the axial direction of the image carrier.

3. The image forming apparatus according to claim 2, wherein the partition members are arranged at least at the central position of the axial direction of the image carrier.

4. The image forming apparatus according to claim 1, wherein the partition members are formed of an elastic porous member.

5. The image forming apparatus according to claim 4, wherein the elastic porous member is a sponge.

* * * * *